United States Patent [19]

Pala et al.

[11] Patent Number: 4,492,012

[45] Date of Patent: Jan. 8, 1985

[54] METHOD OF MAKING ROLL FOR USE IN PRINTING

[75] Inventors: Jerome Pala, Arlington Heights; Yale Karmell, Chicago; Thaddeus M. Muzyczko, Downers Grove, all of Ill.

[73] Assignee: Samuel Bingham Company, Mt. Prospect, Ill.

[21] Appl. No.: 339,163

[22] Filed: Jan. 13, 1982

[51] Int. Cl.[3] ..... B21K 1/02

[52] U.S. Cl. ..... 29/148.4 D; 29/120; 29/132

[58] Field of Search ..... 29/120, 131, 132, 148.4 D

[56] References Cited

U.S. PATENT DOCUMENTS

| | | | |
|---|---|---|---|
| 2,775,195 | 12/1956 | Martin | 29/131 X |
| 2,823,402 | 2/1958 | Phillips | 29/120 X |
| 3,184,355 | 5/1965 | Brown . | |
| 3,460,222 | 8/1969 | Mitchell, Jr. | 29/132 X |
| 3,808,657 | 5/1974 | Menges et al. . | |
| 3,852,862 | 12/1974 | Sukenik | 29/132 |
| 3,998,681 | 12/1976 | Williams et al. | 29/120 X |

*Primary Examiner*—Howard N. Goldberg
*Assistant Examiner*—Carl J. Arbes
*Attorney, Agent, or Firm*—Lockwood, Alex, Fitzgibbon & Cummings

[57] ABSTRACT

A roll for use in a printing operation and a method of making same is disclosed. The roll includes a tubular mesh sleeve which is covered with an elastomer composition, such as a Buna-N rubber. The composition includes discrete fibers, such as nylon fibers, which are substantially uniformly dispersed in the composition. The sleeve is stretched over a metal mandrel and the composition, with the fibers therein, is extruded onto the sleeve to form a seamless covering which is vulcanized to the sleeve. The mandrel is removed and the sleeve with its vulcanized covering is then bonded to a metal core by a suitable adhesive, such as an epoxy adhesive, and the outer surface of the covering is ground to raise a nap of the fibers and cleaned to remove any foreign matter not anchored to the coating.

26 Claims, 1 Drawing Figure

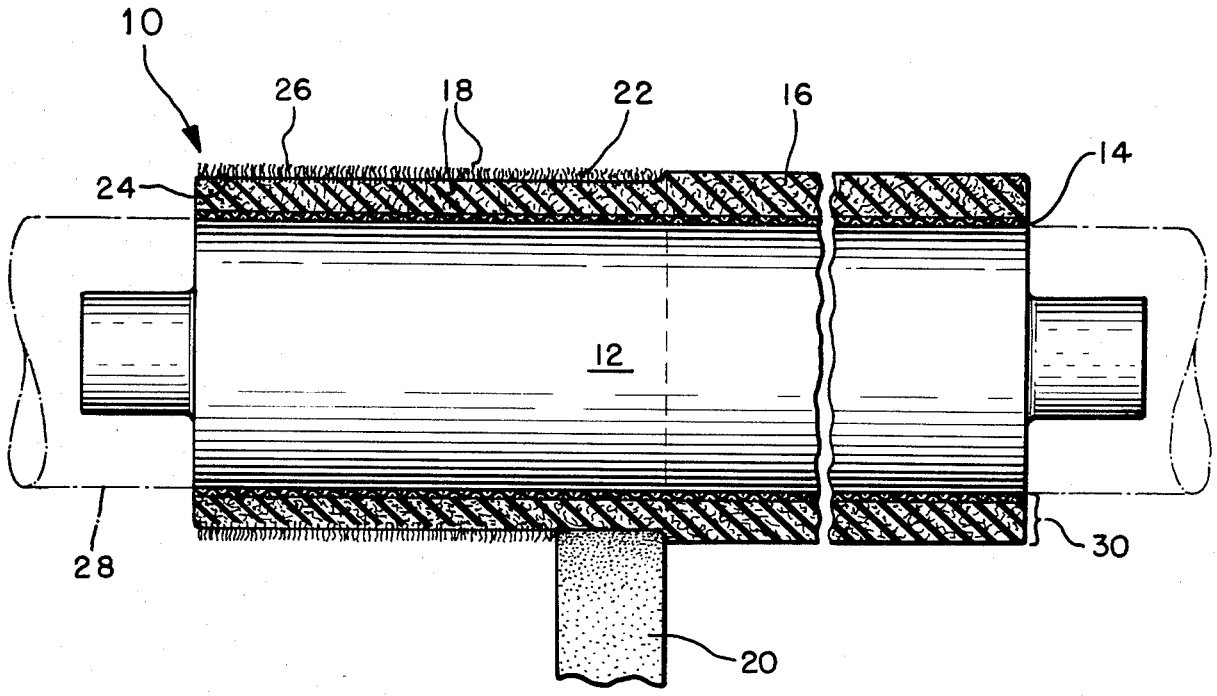
10
26
18
22
16
14
24
12
28
30
20

METHOD OF MAKING ROLL FOR USE IN PRINTING

BACKGROUND AND SUMMARY OF THE INVENTION

The present invention relates to a roll for use in a printing operation and a method of making same and, more particularly, to a roll for removing undesirable foreign materials from the plates of a printing press and a method of making such roll.

The presence of undesirable foreign materials in printing operations causes defects in the printed product. Such foreign materials or particles are generally referred to in the trade as "hickies". If such hickies are not removed from the printing plates, they prevent the application of ink to all areas of the image resulting in small spots or defects. Hickies may, for example, include such foreign materials as dried ink specks, slitter dust, lint, paper specks, felt hairs and the like.

A number of different methods and apparatus have been employed in the past for removal of such hickies. Many of these apparatus involve the use of either natural or synthetic materials which are expensive or which may be difficult to clean.

In the United States Letters Patent No. 3,808,657 (MENGES et al), a roll is disclosed in which a flat calendered sheet of a rubber material is formed and in which nylon fibers are dispersed in the material. This calendered sheet is then wound upon a metal core and is vulcanized to the core. After vulcanization, the outer surface of the fiber filled covering is ground to produce a napped surface to form a hickey picker roll.

The hickey picker roll disclosed in the aforementioned Letters Patent and the method of making the roll suffer several disadvantages. One disadvantage is that the finished product has a seam which, in many instances, is undesirable. Another disadvantage is that the covering with the fibers therein is vulcanized directly to the heavy metal core. Accordingly, shipping expenses are substantially increased and refinishing of the rolls must be done at a facility which has the full mixing and vulcanizing capability as is required for the formation of the roll. Such facilities are not normally available in the field. Still another disadvantage of the aforementioned method is that separate sheet forming and winding steps are necessary which increases the cost of making the roll and necessitates additional equipment to perform these separate steps.

A principle purpose of the present invention is the formation of a roll which overcomes these several disadvantages and which roll is capable not only of picking hickeys, but what may also be used to carry water. The roll incorporating the principles of the present invention is preferably formed by extrusion of a covering containing the fibers dispersed therein onto a tubular mesh sleeve and the covering is vulcanized to the sleeve. Accordingly, the formed roll is seamless and the subassembly thereby formed need not include the heavy metal core. Thus, the vulcanized subassembly is lightweight and may easily be shipped to final processing facilities in the field where it may there be bonded to the heavier metal cores to the form the final roll. Shipping expenses are accordingly substantially reduced and turnaround time for the reprocessing of such rolls is also substantially reduced. Moreover, formation of the subassembly itself may take place at a fairly sophisticated central manufacturing facility where extensive and expensive test equipment, such as x-ray analysis apparatus may be present. Such equipment is not usually available in the field. It will also be seen that the roll and method of making the roll incorporating the principles of the present invention utilizes a one-step extrusion operation which eliminates the multiple sheet forming and winding steps of the prior art. The roll of the present invention may be formed of inexpensive, readily available materials and may be easily washed or otherwise cleaned in use by conventional materials and methods.

In one principle aspect, a roll incorporating the principles of the present invention for use in a printing operation includes a tubular mesh sleeve and a covering on the sleeve comprising an elastomer composition having a plurality of discrete fibers substantially uniformly dispersed therein, the covering being vulcanized to the sleeve.

In another principal aspect, the aforementioned roll includes a metal core and the tubular mesh sleeve is bonded to the core. A portion of the composition at the surface of the covering opposite the mesh sleeve is removed therefrom such that the ends of the fibers are anchored in the composition while opposite ends of the fibers are free to define a nap on the roll, and the nap is free of all matter which is not anchored to the composition.

In still another principal aspect of the present invention, a method of making a roll for use in a printing operation includes the steps of stretching a tubular mesh sleeve onto a metal mandrel, covering the sleeve with an elastomer composition having a plurality of discrete fibers substantially dispersed therein, vulcanizing the covering to the sleeve, and removing the mandrel.

These and other objects, features and advantages of the present invention will become clear upon a consideration of the following detailed description.

BRIEF DESCRIPTION OF THE DRAWING

In the course of this description, the drawing will frequently be referred to in which the sole FIGURE shows a roll in solid in accordance with the principles of the present invention and also shows the roll in its preforming steps on a mandrel as shown in dot-and-dash.

DETAILED DESCRIPTION OF THE PREFERRED EMBODIMENT

A roll constructed in accordance with the principles of the present invention and the method of forming the roll are shown in the drawing.

In general, the roll 10 comprises a metal core 12 which is formed of a suitable hard material, such as steel. A tubular mesh sleeve 14 is bonded to the core 12 by a suitable adhesive as will be described in further detail to follow. An elastomer composition coating 16, having discrete fibers 18 therein, is vulcanized to the sleeve 14. The outer surface of the elastomer covering 16 is ground or abraded by suitable means, such as a conventional carborundum grinding wheel 20, to form a raised nap 22 of the fibers 18, such that one end 24 of the fibers is anchored in the covering 16 and the other end 26 is free standing.

The tubular mesh sleeve 14 may be formed of any one of a number of different materials. The sleeve 14 may be woven or otherwise formed, for example of cotton fibers and is in the form of stretchable material in the nature of a stretchable sock prior to application of the elastomer.

The elastomer composition in covering 16 is preferably formed of an elastic rubber or rubber-like polymer, such as Buna-B rubber. A suitable elastomeric polymer is available from B. F. Goodrich as its medium acrylonitrile or from Polysar as its "Krynac 3850". The elastomer which is selected is preferably resistant to aliphatic and aromatic hydrocarbons and also to water and, preferably, has a Shore A durometer hardness of 20–50 after vulcanizing.

The thickness of the elastomer covering 16 on roll 10 may be, for example ½ inch, plus or minus ¼ inch.

The fibers 18 may be formed of any fibrous material which is capable, when napped in accordance with the principles of the present invention, of picking up matter, such as hickies or water. The preferred fiber material of the present invention is nylon fibers. Suitable nylon fibers are available from Claremont Flock corp., Claremont, New Hampshire, as their NRT-25 or NRT-27 fibers. Those fibers are 0.160 and 0.180 inch long, respectively, and are approximately 52 denier. It will be understood, however, that the choice of deniers and lengths may be varied depending upon the circumstances, for example, the denier may vary between ±20 and the lengths of the fibers may also vary up to double the last-mentioned lengths.

The amount of fibers in the elastomer covering 16 may be between 5 and 45 parts by weight. The preferred amount is about 25 parts by weight.

An example of a suitable formulation for the covering 16 is as follows.

The basic compound is prepared by 2-roll mill mixing (Parrel—60 inch mill at 140° F.), the following ingredients in the order listed:

Krynac 3850 (Polysar, Sarnia, Canaca) 100 parts is banded in the mill. Next add 1.5 parts sulfur. Zinc oxide (5 parts) (St. Joseph Lead, St. Joseph's , Mich.) is then blended in. Stearic acid 1.0 part is incorporated, and then thirty parts of vulcanized vegetable oil is added (Neophax, American Cyanamid) followed by 10 parts MT Black (Vanderbilt Co.) and 10 parts Whitex Clay (Donald Fitzgerald Co., Chicago).

A mixture of dioctyl phthalate (DOP) and silica (110 parts) is then added, followed by 30 more parts of DOP. The nylon flock (Claremont Flock Co., Claremont, N.H.) (25 parts) is randomly spinkled in. Finally, Altax (MBT) (Vanderbilt Co.) 1.5 parts is added.

This stock is fed into a rubber extruder and either first extruded as a tube and then slipped over a sleeve 14 stretched on mandrel 28 or directly cross-head extruded onto the mandreled sleeve 14.

A preferred method of forming the roll of the present invention will now be described.

The stretchable tubular mesh sleeve 14 is first stretched upon a suitable cylindrical forming mandrel 28 as shown in dot-and-dash in the drawing. Prior to extrusion of the coating 16 on the sleeve, a solution of Buna-N rubber in methyl ethyl ketone is next preferably painted on the sleeve to improve the adhesion of the covering 16 to the sleeve 14.

The elastomer coating 16 with the plurality of discrete fibers 18 is next coated upon the sleeve 14, preferably by extrusion as just described. Because the covering is extruded upon the sleeve, no seams appear in the final product. The covering is then wrapped in a conventional manner with paper or other suitable wrapping material (not shown) to confine the covering 16. This covering is then vulcanized such as by steam vulcanizing in a well-known manner. Such vulcanization may take upwards from 2 to 10 hours at 260°–330° F.

When vulcanization is completed, the paper wrapping may be removed and the mandrel 28 withdrawn, leaving a flexible, resilient tubular shaped subassembly 30. These subassemblies may be tested or otherwise examined by fairly sophisticated test equipment and methods such as x-ray analysis, to detect any flaws at the location of their manufacture.

Once the subassembly is determined to be flawless, the subassemblies may be shipped to field facilities where they may be used to renovate or restore worn or deteriorated rolls which are delivered to the field facilities from the ultimate users—the printers.

At the field facility, the tubular mesh sleeve 14 is impregnated with a sufficient quantity of a two-part epoxy-based resin, or a polyurethane or other suitable metal-to-fabric adhesive so as to thoroughly saturate the sleeve 14.

One example of a suitable two-part adhesive, the two parts of which are mixed in substantially equal quantities in well-known manner, is as follows, with the specific quantities of the individual constituents indicated as parts by weight:

| Part A | |
|---|---|
| Liquid diepoxide resin | 3000 |
| Methyl ethyl ketone | 250 |
| Toluol | 250 |
| | 3500 |

| Part B | |
|---|---|
| Amine terminated polyamide | 2500 |
| Tetra ethylene pentamine | 150 |
| Tertiary amine catalyst | 60 |
| Toluol | 400 |
| Methyl ethyl ketone | 400 |
| | 3510 |

The epoxy-saturated form is then slipped over a clean metal core 12 while the epoxy adhesive is still wet and the roll is allowed to stand overnight or for such suitable time as to allow for setting and curing of the adhesive to bond the sleeve 14, and thereby the subassembly 30 to the core 12. The core 12 may be either a new core or may be one which was previously used and from which the old covering was first removed in a conventional manner and the core cleaned, such as by sandpaper.

Once the adhesive has cured, the subassembly 30 on the core 12 is ground in a lathe by a conventional grinding wheel 20 so as to raise the nap 22 as shown in the drawing. The depth of the nap is preferably about 1/16 inch, but may vary as desired. The 1/16 inch nap has been found to be suitable for hickey removal and water transmittal and still leaves a sufficient depth of elastomer covering, where the overall thickness of the covering before grinding was ½ inch, to allow for further grinding operations to be performed on the roll to renovate the roll without removing the coating as wear occurs.

Finally, the ground napped roll is cleaned as by thorough vacuuming to remove any and all loose or extraneous matter which is not anchored to the covering 16 to prevent this matter itself from forming hickies.

It will be understood that the preferred embodiment of the invention which has been described is merely illustrative of only a few of the principles of present invention. Numerous modifications may be made by those skilled in the art without departing from the true spirit and scope of the invention.

What is claimed is:

1. A method of making a roll for use in a printing operation comprising:

stretching a tubular mesh sleeve onto a metal mandrel;

covering said sleeve with an elastomer composition having a plurality of discrete fibers substantially dispersed therein;

vulcanizing said covering to said sleeve; and removing said mandrel.

2. A method of making a roll for use in a printing operation comprising:

stretching a tubular mesh sleeve onto a metal mandrel;

covering said sleeve with an elastomer composition having a plurality of discrete fibers substantially dispersed therein;

vulcanizing said covering to said sleeve to form a subassembly;

removing said mandrel;

slipping said subassembly over a metal core and adhesively bonding said subassembly thereto;

removing a portion of said composition from the surface of said composition opposite said sleeve such that the ends of said fibers are anchored in said composition while opposite ends of said fibers are free to define a nap on said roll; and cleaning said nap to free it of all matter which is not anchored to said composition.

3. The method of claim 1 wherein said sleeve is a woven cotton mesh.

4. The method of claim 1 wherein said elastomer is Buna-N rubber.

5. The method of claim 1 wherein said fibers are synthetic.

6. The method of claim 5 wherein said fibers are nylon.

7. The method of claim 1 wherein said fibers are present in said covering in an amount of about 5–45 parts by weight of said covering.

8. The method of claim 7 wherein said fibers are present in said covering in an amount of about 25 weight percent of said covering.

9. The method of claim 1 wherein said fibers are about 32–72 denier and are about 0.160–0.360 inch in length.

10. The method of claim 3 wherein said fibers are about 52 denier and are about 0.160–0.180 in length.

11. The method of claim 1 wherein said covering is about one-half inch thick.

12. The method of claim 1 wherein said covering is extruded upon said sleeve and is seamless.

13. The method of claim 1 wherein said sleeve is a woven cotton mesh, said elastomer is Buna-N rubber, said fibers are nylon and are present in said covering in an amount of about 5–45 parts by weight of said covering, said fibers being about 32–72 denier and about 0.160–0.360 inch in length, said covering is about one-half inch thick, and said covering is extruded upon said sleeve and is seamless.

14. The method of claim 2 wherein said sleeve is a woven cotton mesh.

15. The method of claim 2 wherein said elastomer is Buna-N rubber.

16. The method of claim 2 wherein said fibers are synthetic.

17. The method of claim 16 wherein said fibers are nylon.

18. The method of claim 2 wherein said fibers are present in said covering in an amount of about 5–45 parts by weight of said covering.

19. The method of claim 12 wherein said fibers are present in said covering in an amount of about 25 parts by weight of said covering.

20. The method of claim 2 wherein said fibers are about 32–72 denier and are about 0.160–0.360 inch in length.

21. The method of claim 20 wherein said fibers are about 52 denier and are about 0.160–0.180 in length.

22. The method of claim 2 wherein said covering is about one-half inch thick.

23. The method of claim 2 wherein said covering is extruded upon said sleeve and is seamless.

24. The method of claim 2 wherein said tubular mesh sleeve is bonded to said core with an epoxy adhesive.

25. The method of claim 2 wherein the thickness of said nap is about 1/16 inch.

26. The method of claim 2 wherein said sleeve is a woven cotton mesh, said elastomer is Buna-N rubber, said fibers are nylon and are present in said covering in an amount of about 5–45 parts by weight of said covering, said fibers being about 32–72 denier and about 0.160–0.360 inch in length, said covering is about one-half inch thick, said covering is extruded upon said sleeve and is seamless, and said mesh sleeve is bonded to said core with an epoxy adhesive.

* * * * *